US005347840A

United States Patent [19]

Wolfgang et al.

[11] Patent Number: 5,347,840

[45] Date of Patent: Sep. 20, 1994

[54] PRESS COMPRISING A PRESS TABLE AND A SLIDING TABLE

[75] Inventors: Michael Wolfgang, Göppingen; Lauke Andreas, Gruibingen; Fritz Werner, Karlsruhe, all of Fed. Rep. of Germany

[73] Assignee: L. Schuler GmbH, Fed. Rep. of Germany

[21] Appl. No.: 931,203

[22] Filed: Aug. 17, 1992

[30] Foreign Application Priority Data

Aug. 17, 1992 [DE] Fed. Rep. of Germany ..... 4127237

[51] Int. Cl.[5] ..... B21J 13/04

[52] U.S. Cl. ..... 72/455; 72/446; 72/701; 100/258 A

[58] Field of Search ..... 72/446, 455, 701; 100/258 A, 258 R

[56] References Cited

U.S. PATENT DOCUMENTS

| | | | |
|---|---|---|---|
| 3,914,975 | 10/1975 | Kawano | 100/258 A |
| 4,557,792 | 12/1985 | Yamada et al. | 100/258 A |
| 4,589,836 | 5/1986 | Fjellman | 72/701 |
| 5,012,665 | 5/1991 | Brandstetter . | |
| 5,067,340 | 11/1991 | MacGregor | 100/258 A |
| 5,156,782 | 10/1992 | Ballantyne | 100/258 A |

FOREIGN PATENT DOCUMENTS

| | | | |
|---|---|---|---|
| 484623 | 5/1992 | European Pat. Off. | 72/448 |
| 1452677 | 4/1969 | Fed. Rep. of Germany . | |

*Primary Examiner*—David Jones

*Attorney, Agent, or Firm*—Evenson, McKeown, Edwards & Lenahan

[57] ABSTRACT

A materials press comprising a press table and a sliding table. The contact surfaces between the press table and the sliding table have surface contours which conform to a bending line which would occur in a planar press table when it is placed under a load.

20 Claims, 4 Drawing Sheets

PRESS COMPRISING A PRESS TABLE AND A SLIDING TABLE

BACKGROUND AND SUMMARY OF THE INVENTION

This invention relates to a press for forming sheet metal and other materials, which includes an arrangement to compensate for deformation forces generated during the pressing operation.

In the process of forming of sheet metal, plastic or similar materials in a press, forces are generated which result in a bending of the sliding table and the press table. As a result, the formed workpieces are inexact and deformed, and the upper parts and lower parts of the tools are stressed excessively and non-uniformly because of the bending of the tool clamping plate.

One way to minimize bending with respect to the wearing of the tools, and the resulting inaccuracy of the finished parts, is to provide the bearing walls of the press table and the sliding table with a stiffer design. However, for reasons of weight and transport, this measure can be carried out only to a limited extent.

Sliding tables are known which can be moved out of the press for a change of tools, such as disclosed, for example, in German Patent Document DE 39 05 069 A1. Although a rigid design of bearing walls of the press table and of the sliding tables is not expressly addressed in this patent document, a measure of this type for the reduction of the bending during the forming appears implicit in the disclosure.

German Patent Document DE-OS 14 52 677 discloses an arrangement which automatically compensates for bending in the case of presses, by means of a pressure-compensating intermediate layer, which is enclosed on all sides. For this purpose, the intermediate layer is arranged on a side of the workpiece that faces the press components, between the tool and the press component which is subject to bending under the force of the pressure. A counterpressure device which acts upon the center of the crosshead is supported against an elastically deforming belt, and counterpressure is generated by means of straining screws or by the piston rod of a hydraulic cylinder.

It is an object of the present invention to compensate for bending during the forming of different workpieces and molds and the resultant varying pressure forces. It is a further object of the invention to provide an arrangement to counteract the physically unavoidable bending stresses in the tool clamping plate in order to maintain the tool clamping plate in a planar state.

A special advantage of the invention is the fact that the unavoidable deformation of the press table does not cause a defect in the tool clamping plate and in the tool. On the other hand, defects in the tool, which would otherwise require changing the tool, can be compensated by targeted variation in the bending of the tool clamping surface.

Another advantage of the invention is that, by means of the supporting devices, it can compensate not only for those bends which are caused by the deforming, but also those caused by sheet metal holding forces which may occur earlier, and therefore result in bending or deformation. Because the supporting devices are arranged in the corner areas of the sliding table, they support only a small portion of the load, the main load being borne in the area where the sliding table rests on the press table.

Other objects, advantages and novel features of the present invention will become apparent from the following detailed description of the invention when considered in conjunction with the accompanying drawings.

DETAILED DESCRIPTION OF THE DRAWINGS

Figure 1:
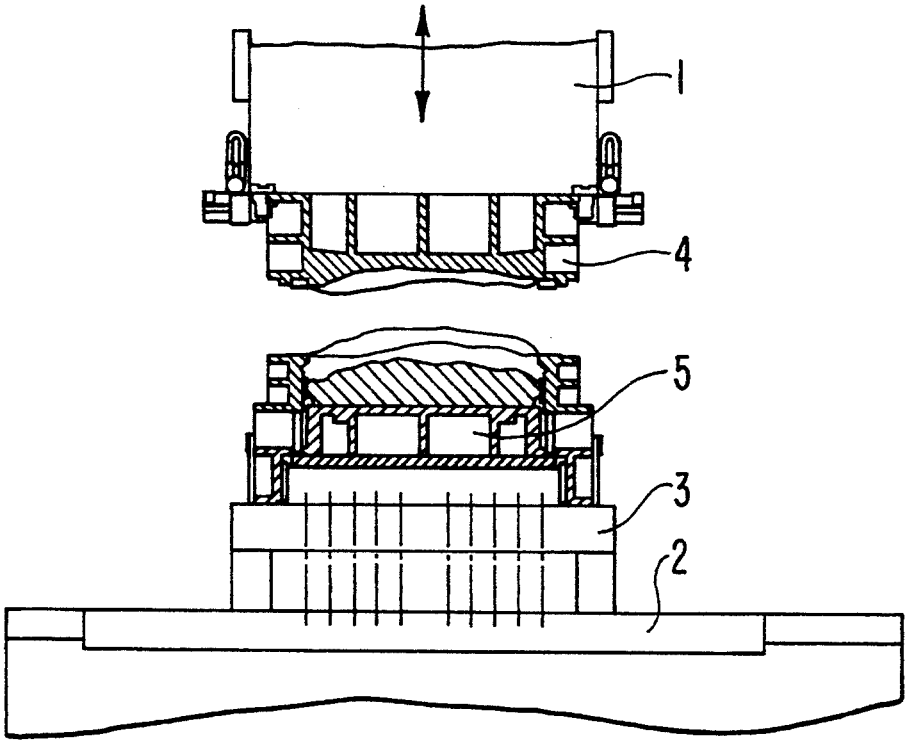
FIG. 1 is a view of the tool area of a press according to the invention.

Referring to the drawing, in FIG. 1, a sliding table 3 is arranged on the press table 2. For tool changes, the sliding table 3 can be moved into and out of the press. The tool area, with a press slide 1 which moves up and down, is shown as part of the press. A top tool element 4 is moved by the press slide 1 and, when a material is placed in-between, interacts with a bottom tool element 5 on the sliding table 3 to shape the material into the desired configuration.

Figure 2:
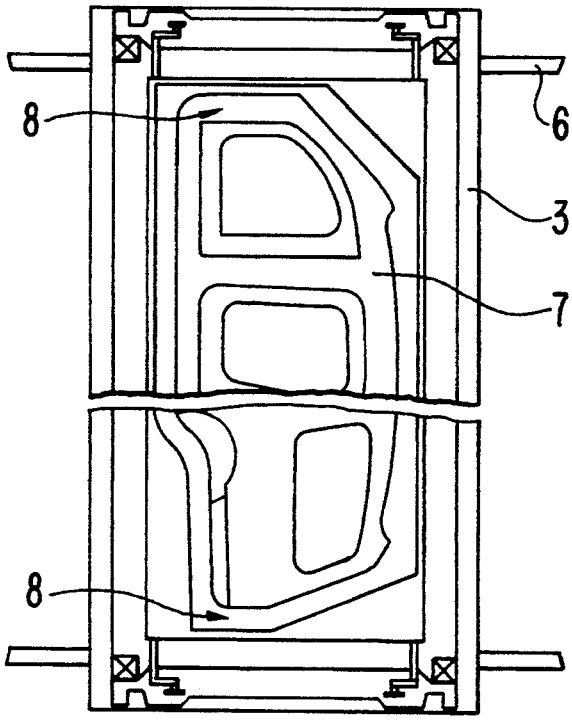
FIG. 2 is a top view of a sliding table with a workpiece placed on it.

FIG. 2 shows a sheet metal part 7 placed in or on the bottom tool element on the sliding table 3. Reference number 8 indicates edge areas that are situated far away from the center of sheet metal part 7, which will be discussed in detail in connection with FIGS. 6 to 8.

Figure 3:
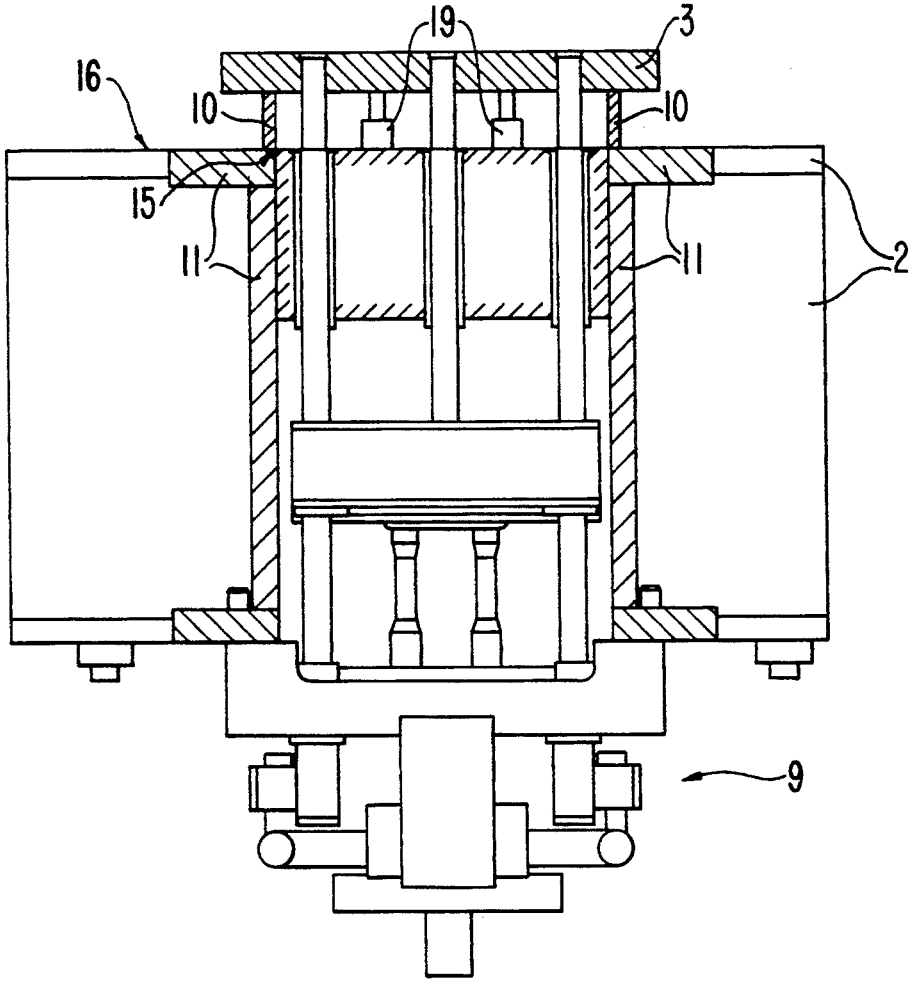
FIG. 3 is a sectional view of a press table of a press with a sliding table arranged on the press table.
Figure 4:
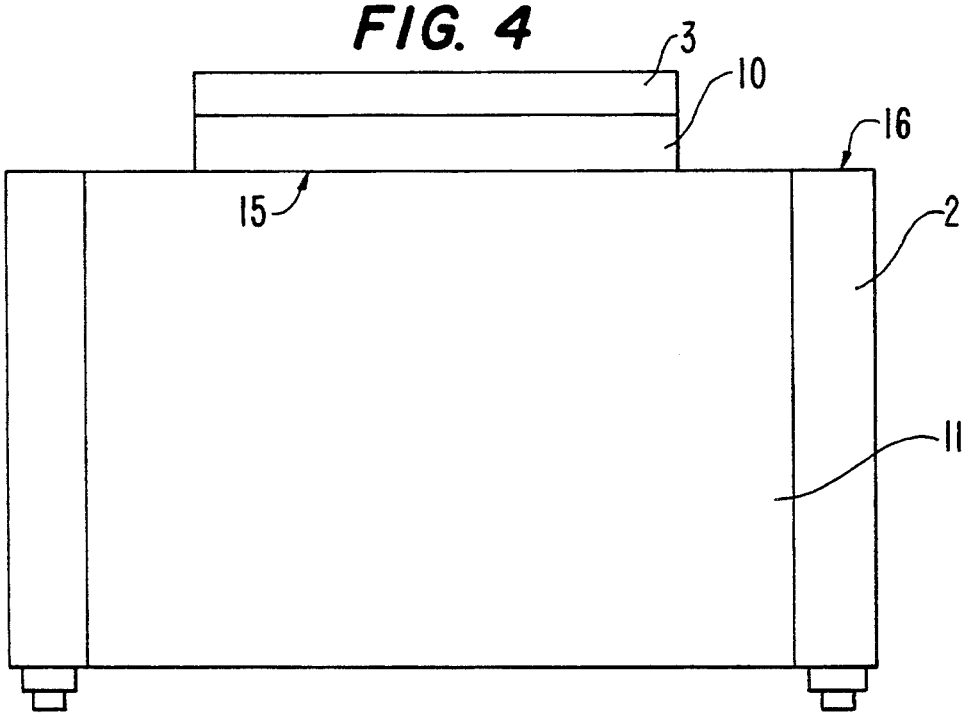
FIG. 4 is a lateral view of a press table with the sliding table arranged on it.

FIG. 3 illustrates a press table 2 with a sliding table 3 placed on it, as well as a drawing device 9 of a machining stage. The drawing device 9 is used for holding the sheet metal before the actual forming operation, so that the press table 2 is loaded first by the sheet metal holding and subsequently, in addition, by the forming of the sheet metal piece. The sliding table 3 has bearing walls 10 which extend in its longitudinal direction and transverse direction, as shown in FIGS. 3 and 4. The longitudinal bearing walls 10 have downward facing contact surfaces 15 which are supported on upward facing contact surfaces 16 of the bearing walls 11 of the press table 2. FIG. 4 shows a planar design of the contact surfaces 15, 16.

Figure 5:
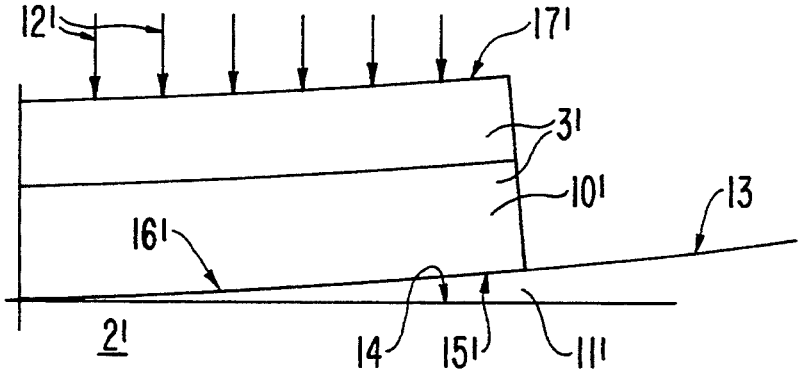
FIG. 5 is a symbolic representation of bearing longitudinal walls of the press table and the sliding table under the load of the press, without the compensating measures according to the invention.

FIG. 5 is a graphic depiction of an example of the state of a art press table $2^1$ with bearing walls $11^1$ and a sliding table $3^1$, with the bearing walls $10^1$ bent as shown by arrows $12^1$, when it is loaded The tool clamping surface $17^1$, which is planar before the loading, will assume an uneven shape; likewise, the contact surfaces 15[1] on the sliding table 3[1] and the contact surfaces 16[1] on the press table. The loading of the press table and the sliding table 3[1] leads to a bending of the surfaces, as indicated by the bending line 13, with contact surfaces 15[1] and 16[1] conforming to the shape of the bending line 13. The starting line 14 indicates the unloaded configuration of the press table and the sliding table 3[1]. It is easily recognizable that the uneven tool clamping surface 17[1] considerably influences the contour of a tool clamped onto it, and thus its finishing accuracy. The uneven areas in the surfaces 15[1], 6[1], 17[1] are exaggerated in order to clearly show the deviations in the drawing. The actual deviations are in the range of a tenth of a millimeter.

Figure 6:
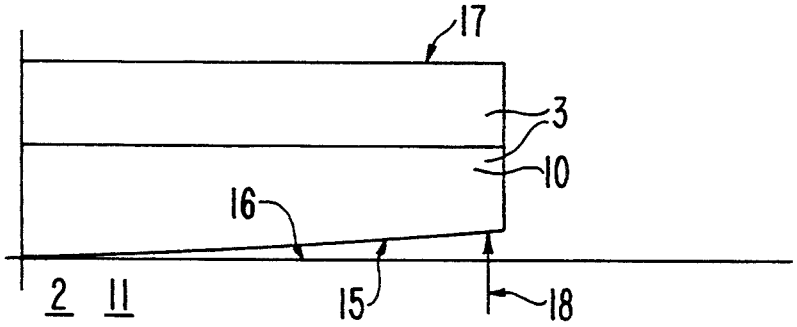
FIGS. 6 to 8 are symbolic representations of longitudinal walls of the press table and the sliding table according to the invention in the unloaded, partially loaded, and loaded condition respectively.

In a first development according to the invention, FIG. 6 shows a bearing wall 11 of the press table 2 which has a planar contact surface 16. A sliding table 3 with a planar tool clamping surface 17 is arranged on the press table 2. It is the object of the present invention to maintain the upper surface of the sliding table 2 in a planar state during operation of the press; that is during the application of a load in the forming process.

According to the invention, the contact surface 15 of the sliding table bearing wall 10 is shaped to conform to the bending line 13 in FIG. 5, for example, by metal cutting such as milling. In the four corner areas (indicated at one corner area by means of an arrow 18 in FIG. 6), supporting devices are fastened between the press table 2 and the sliding table 3. These may be, for example, motor—spindle lifting devices or hydraulic pressure cylinders, the working length of which can be adjusted by means of a control.

Figure 7:
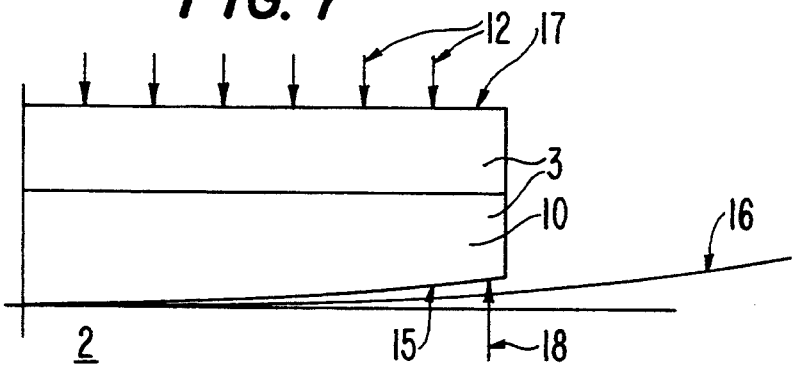
Figure 8:
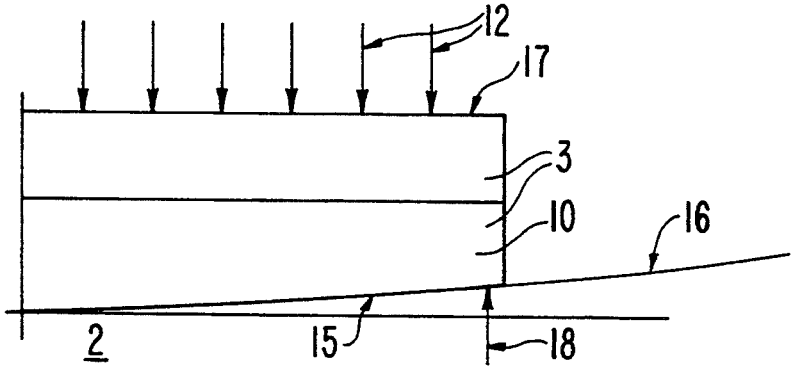
Figure 9:
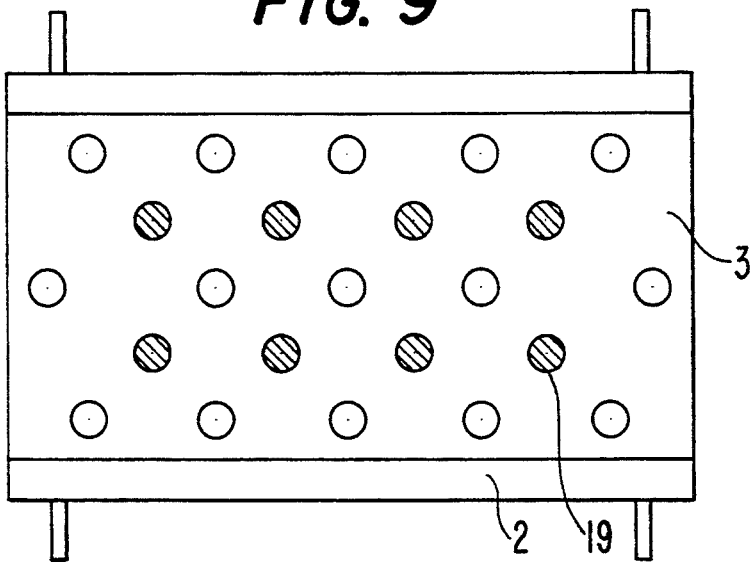
FIG. 9 is a view of a sliding table with supporting devices in its center area.

Because of the load generated during forming (arrows 12 in FIGS. 7 an 8), and because the area of contact between the contact surface 15 and the contact surface 16 of the press table 2 is limited initially to the center area, the contact surface 16 will deform, as indicated in FIGS. 7 and 8. When the full load is reached, the contact surface 16 of the press table 2 is elastically deformed to such an extent that it supports the sliding table 3 by means of all contact surfaces. (See FIG. 8.)

The supporting devices 18 support the corner areas of the sliding table 3 in the unloaded condition, as well as when a load is applied, and during the unloading operation. The forming operation in the areas (reference numeral 8 in FIG. 2) which are remote from the center area of the sliding table 3 also causes a loading of the sliding table 3. These areas are supported by supporting devices 18.

In another embodiment of the invention, the press table 2 has an upwardly convex bending line 13, and planar or convex contact surfaces 16 of the sliding table 3. In this embodiment, the sliding table 3, which has moved into the press, after its lowering, therefore rests at first only with its center area on the press table 2.

With respect to the operation of the supporting devices 18 at the corners of the sliding table, it should be noted that in the unloaded condition the sliding table 3, which rests in its center area on the press table 2, is supported by the supporting devices 18, the working length of which can be adjusted. During the forming of the workpiece in the tool, the supporting devices are controlled to adapt to the bending of the press table as a load is applied; that is, the working length is shortened correspondingly. In the case of maximum pressure, the contact surfaces 15 may rest on the contact surfaces 16 along their overall length. During the unloading phase, the supporting devices 18 are again adjusted (lengthened) as the bending of the press table 2 diminishes, until the unloading is completed.

The control of the supporting devices 18 makes it possible, on the one hand, for the tool clamping surface 17 to remain planar in all forming phases. On the other hand, such control also makes it possible to achieve a predetermined deformation of the tool clamping surface 17 in order to compensate for undesirable tool characteristics; that is, defects in the tool. For this purpose one or the other of the supporting devices 18 is precontrolled by means of a control quantity during the set-up of the press or of the tool.

Figure 10:
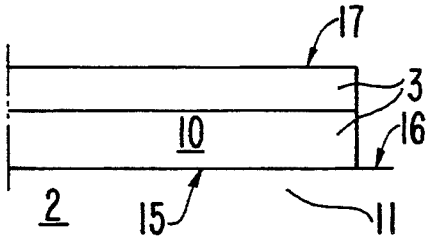
FIGS. 10 to 12 are a series of symbolic representations of longitudinal walls on the press table and the sliding table with supporting devices in the center area of the sliding table in the unloaded, the partially loaded, and completely loaded condition respectively.
Figure 11:
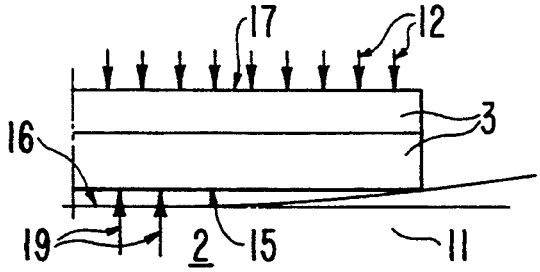
Figure 12:
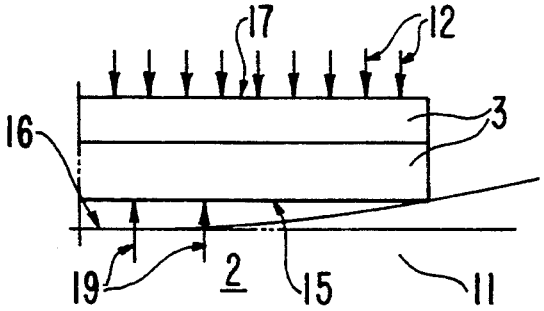

Another embodiment of the invention shown in FIGS. 9 to 12 includes additional supporting units 19 of a mechanical, electromechanical or hydraulic nature, as indicated above. In the top view in FIG. 9, the supporting units are situated and move essentially in the center area of the sliding table 3. (In FIG. 3, such supporting devices 19 are shown between the press table 2 and the sliding table 3. ) The supporting devices 19, whose number is adapted to the forming conditions and thus to the forming in the tools, are supported on the press table 2 and act in the upward direction against the bottom side, for example, the tool clamping plate of the sliding table 3. In FIG. 10, the sliding table 3 and the press table 2 are illustrated in the unloaded condition, with the contact surfaces 15 and 16 on the bearing walls 10 and 11 being planar. However, these surfaces may also be preformed according to the bending line 13 in FIG. 5. According to FIGS. 11 and 12, the supporting devices 19 act on the center area of the sliding table 3. Depending on the extent of the loading of the sliding table 3 and the press table 2, a resetting of the supporting devices 19 may be required in order to maintain the tool clamping surface 17 in its original, unloaded form. In this case, the bending therefore takes place as the deflection of the bearing walls 11 of the sliding table 2.

The control of the supporting devices 18, 19 can be performed individually in separate closed control circuits. For this purpose, the bending of the tool clamping plate is measured, and the measured value is fed to a comparator, whose output signal is amplified and fed to the hydraulic system as the control variable for increasing or decreasing the pressure in the supporting element.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A press comprising:

at least one upwardly and downwardly displaceable press slide adapted to hold a top tool element for forming of materials by pressing at least one stationary press table;

at least one sliding table adapted to hold a bottom tool element for forming of materials by pressing, said at least one sliding table having first bearing walls which are supported on second bearing walls of the press table; and contact surfaces arranged on said first and second bearing walls between said at least one press table and said at least one sliding table, wherein at least one of the contact surfaces has a curved surface contour which conforms to a surface contour of the press table when the press table is in a loaded state.

2. A press according to claim 1, wherein said at least one sliding table is movable into and out of said press to permit a change of tools.

3. A press according to claim 1, wherein the contact surface associated with said at least one sliding table has said curved surface contour.

4. A press according to claim 1, wherein the contact surface associated with said at least one press table has said curved surface contour.

5. A press according to claim 1, wherein the contact surface associated with each of said at least one sliding table and said at least one press table has a curved surface contour.

6. A press according to claim 1, wherein at least one first supporting device, an upward extent of which can be adjusted by means of a control, is arranged in the respective corner areas of the at least one sliding table between the at least one press table and the at least one sliding table.

7. A press according to claim 1, wherein second supporting devices, an upward extent of which can be adjusted by means of a control, are arranged between the at least one press table and the at least one of sliding table.

8. A press according to claim 6, wherein second supporting devices, an upward extent of which can be adjusted by means of a control, are arranged between the at least one press table and the at least one of sliding table.

9. A press comprising:

at least one upwardly and downwardly displaceable press slide adapted to hold a top tool element for forming of materials by pressing;

at least one stationary press table; and at least one sliding table adapted to hold a bottom tool element for forming of materials by pressing, said at least one sliding table having first bearing walls which are supported on second bearing walls of the press table, said sliding table having a central area located substantially equidistantly from corners of said sliding table;

contact surfaces arranged on the first and second bearing walls between said at least one press table and said at least one sliding table;

wherein supporting devices, an upward extent of which can be adjusted by means of a control, are arranged in the central area of said at least one sliding table and act between the press table and the sliding table.

10. A press according to claim 9, wherein the contact surfaces are planar surfaces in an unloaded state.

11. A press according to claim 9, wherein at least one of the contact surfaces has a curved surface contour which conforms to a surface contour of the press table when the press table is in a loaded state.

12. A press according to claim 11, wherein said contact surface associated with at least one sliding table has said curved surface contour.

13. A press according to claim 11, wherein said contact surface associated with said at least one press table said curved surface contour.

14. A press according to claim 11, wherein said contact surfaces of said at least one sliding table and said at least one press have said curved surface contour.

15. A press comprising:

at least one upwardly and downwardly displaceable press slide adapted to hold a top tool element for forming of materials by pressing;

at least one stationary press table; and at least one sliding table adapted to hold a bottom tool element for forming of materials by pressing, said at least one sliding table having first bearing walls which are supported on second bearing walls of the press table, said sliding table having a central area located substantially equidistantly from corners of said siding table;

contact surfaces arranged on the first and second bearing walls between said at least one press table and said at least one sliding table;

wherein supporting devices, an upward extent of which can be adjusted by means of a control, are arranged in the central area of said at least one sliding table and act between the press table and a bottom side of said at least one sliding table.

16. A press according to claim 15, wherein the contact surfaces are planar surfaces in an unloaded state.

17. A press according to claim 15, wherein at least one of the contact surfaces have a curved surface contour when the press is in a loaded state.

18. A press according to claim 17, wherein said contact surface associated with said at least one sliding table has a curved surface contour.

19. A press according to claim 17, wherein said contact surface associated with said at least one press table has a curved surface contour.

20. A press according to claim 17, wherein each of the surfaces of said at least one siding table and said at least one press table has a curved surface contour.

* * * * *